US006573866B2

(12) United States Patent
Chen

(10) Patent No.: US 6,573,866 B2
(45) Date of Patent: Jun. 3, 2003

(54) MULTI-FREQUENCY HIDDEN ANTENNA FOR MOBILE PHONES

(75) Inventor: I-Fong Chen, Tao-Yuan (TW)

(73) Assignee: Auden Techno Corp., Tao-Yuan Hsien (TW)

( * ) Notice: Subject to any disclaimer, the term of this patent is extended or adjusted under 35 U.S.C. 154(b) by 0 days.

(21) Appl. No.: 09/940,445

(22) Filed: Aug. 29, 2001

(65) Prior Publication Data

US 2003/0043079 A1 Mar. 6, 2003

(51) Int. Cl.[7] ..... H01Q 1/38; H01Q 1/48
(52) U.S. Cl. ..... 343/700 MS; 343/846
(58) Field of Search ..... 343/700 MS, 702, 343/846, 848, 752, 829, 795, 825, 830, 831

(56) References Cited

U.S. PATENT DOCUMENTS 5,828,340 A * 10/1998 Johnson ..... 343/700 MS
5,847,682 A * 12/1998 Ke ..... 343/700 MS

* cited by examiner

*Primary Examiner*—Hoang Nguyen
(74) *Attorney, Agent, or Firm*—Troxell Law Office PLLC

(57) ABSTRACT

A multi-frequency hidden antenna for mobile phones, the electric circuit board of the antenna has on the front side thereof two separated grounding areas and an electric supplying line of a single-pole antenna of ¼λ, the open circuit end of the electric supplying line is in the shape of an inverted triangle in a way to form a loaded coplanar waveguide antenna. The electric circuit board is further provided on the rear side thereof with a grounding area, while the electric supplying line on the front side thereof is provided with a short circuit portion of which harmonic oscillation frequency is adjustable in order to form a planar inverted F-antenna (PIFA) to be used together with said coplanar waveguide antenna. Thereby a multi-frequency hidden antenna is formed which can improve bandwidth, radiation efficiency and gain during making coplanar of and miniaturizing the hidden antenna.

1 Claim, 5 Drawing Sheets

MULTI-FREQUENCY HIDDEN ANTENNA FOR MOBILE PHONES

BACKGROUND OF THE INVENTION

1. Field of the Invention

The present invention is related to a multi-frequency hidden antenna for mobile phones; and especially to a planar miniaturized antenna of such kind suitable for using as a multi-frequency transceiver antenna provided in a communication equipment such as a mobile phone.

2. Description of the Prior Art

As the mobile phones were emerged in the markets in early days, most of them used exposed coils of spiral structure as the main elements of antennas. These coil antennas used widely nowadays are divided into two major types—contractible type and fixed type. No matter what type of structure is used, under normal circumstances, it still protrudes with a specific length out of the body's top surface of a mobile phone. The conventional coil antennas become more and more unsuitable for the design requirement of the miniaturized mobile phones, hence microstrip antennas have been developed. Because the characteristics of the microstrip antennas are flatness and small space demanding, such antennas certainly will become the mainstream products for the miniaturized mobile phones.

A microstrip antenna of the early stage, as disclosed in U.S. Pat. Nos. 3,921,177 or 3,810,183, usually consists of a round or rectangular thin metal sheet, and dielectric substance is stuffed between it and the ground; but these microstrip antennas are only compatible with narrower bandwidths. Taiwan Patent No. 81108896 (U.S. patent application Ser. No. 07/798,700) provided a microstrip antenna with diminished size and broadband, however the defects of this kind of antenna are to install the spiral antenna elements on separate ground boards, and to stuff dielectric and loading material of specific thickness between them. The size of the whole antenna was still hard to be further reduced.

Among modern planar inverted F-antennas (PIFA), dual-frequency antennas (IEEE TRANSACTIONS ON ANTENNAS AND PROPAGATION, VOL 45, NO. 10, OCTOBER 1997) are of an ideal type of miniaturized microstrip antenna, however, by the fact that:

Electrical volume of an antenna/frequency band×gain×efficiency=a constant,

So long as the antenna is made planar and miniaturized, its bandwidth and efficiency of radiation will be reduced and will be necessary to be improved.

SUMMARY OF THE INVENTION

The object of the present invention is to provide a multi-frequency hidden antenna for mobile phones, of which the electric supplying line adopts a shortened single-pole antenna of ¼λ, the open circuit end thereof is in the shape of an inverted triangle in order to get a higher gain, and the single-pole antenna of ¼λ is flattened to obtain the desired impedance matching, a short circuit line is provided near the electric supplying point. The short circuit portion is like a loaded capacitor, its harmonic oscillation frequency can be adjusted by changing of its position to get a multi-frequency effect, and thus a planar and miniaturized multi-frequency antenna formed from a coplanar waveguide (CPW) antenna and a planar inverted F-antenna (PIFA) is obtained.

The novelty and other features of the present invention will be apparent after reading the detailed description of the preferred embodiment thereof in reference to the accompanying drawings.

DETAILED DESCRIPTION OF THE PREFERRED EMBODIMENT

Figure 1:
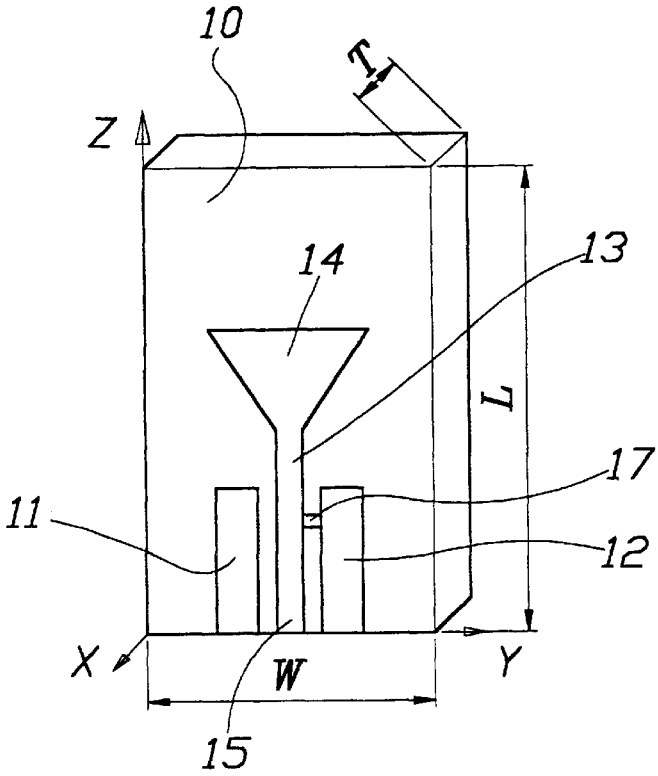
FIG. 1 is a front perspective view of a preferred embodiment of the present invention.
Figure 2:
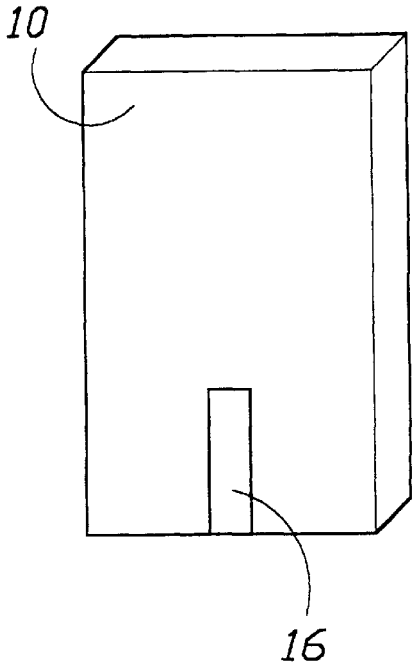
FIG. 2 is a rear perspective view of the preferred embodiment of the present invention.
Figure 4:
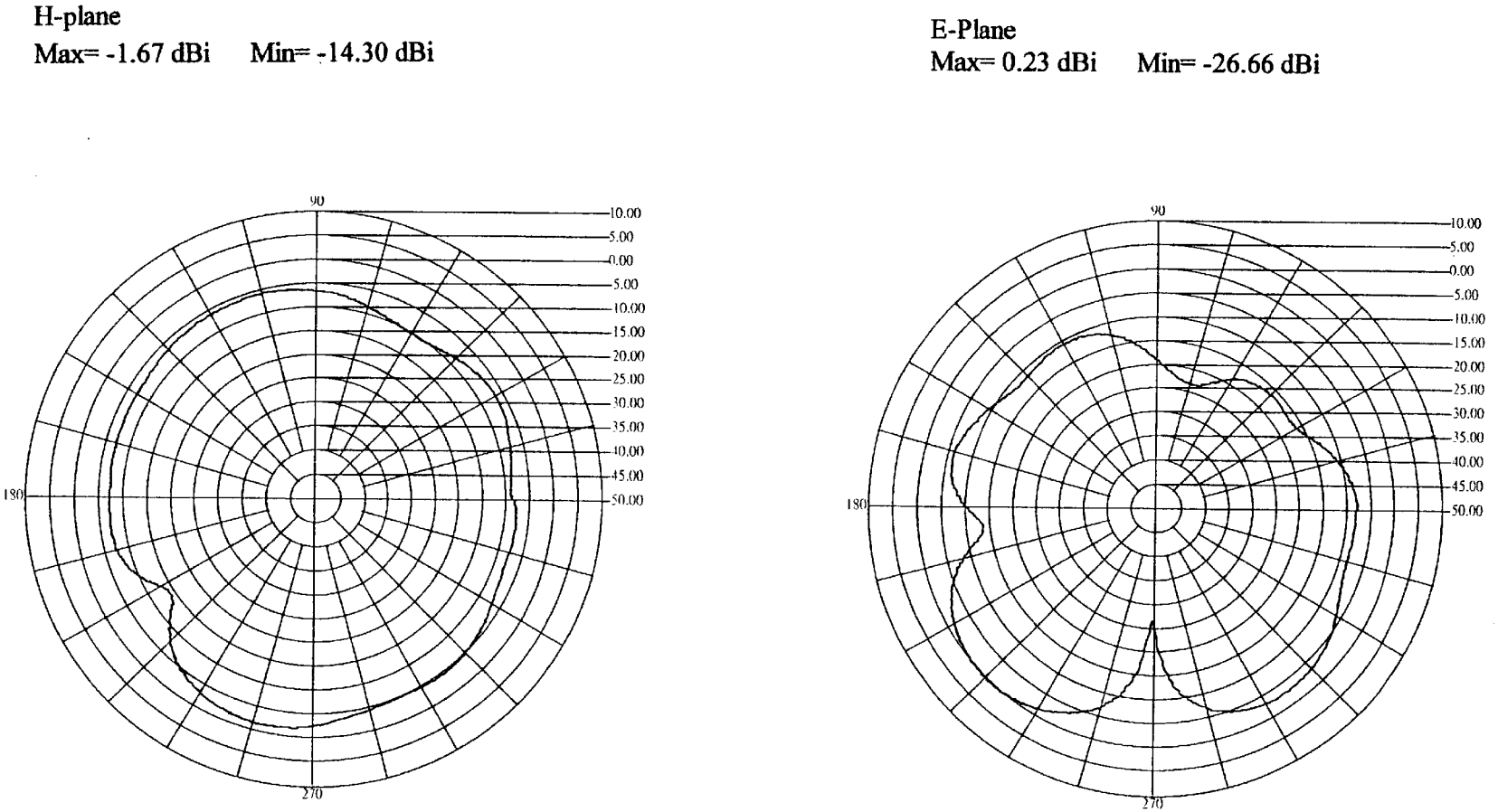
FIG. 4 is a drawing of electromagnetic radiation field used in the present invention for 900 MHz.
Figure 5:
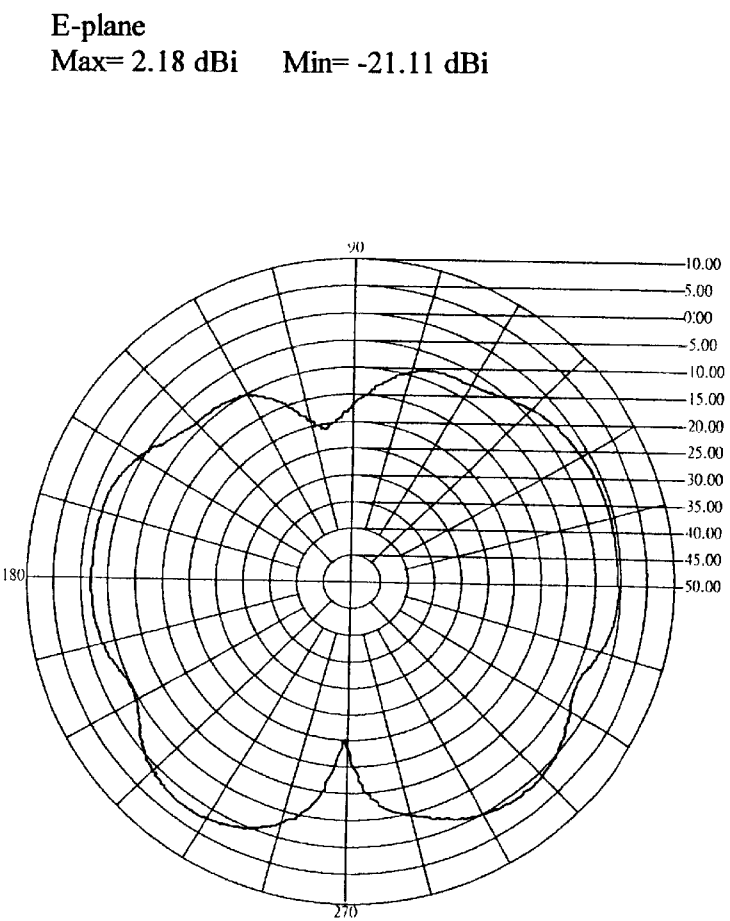
FIG. 5 is a drawing of electromagnetic radiation field used in the present invention for 800 MHz.
Figure 5:
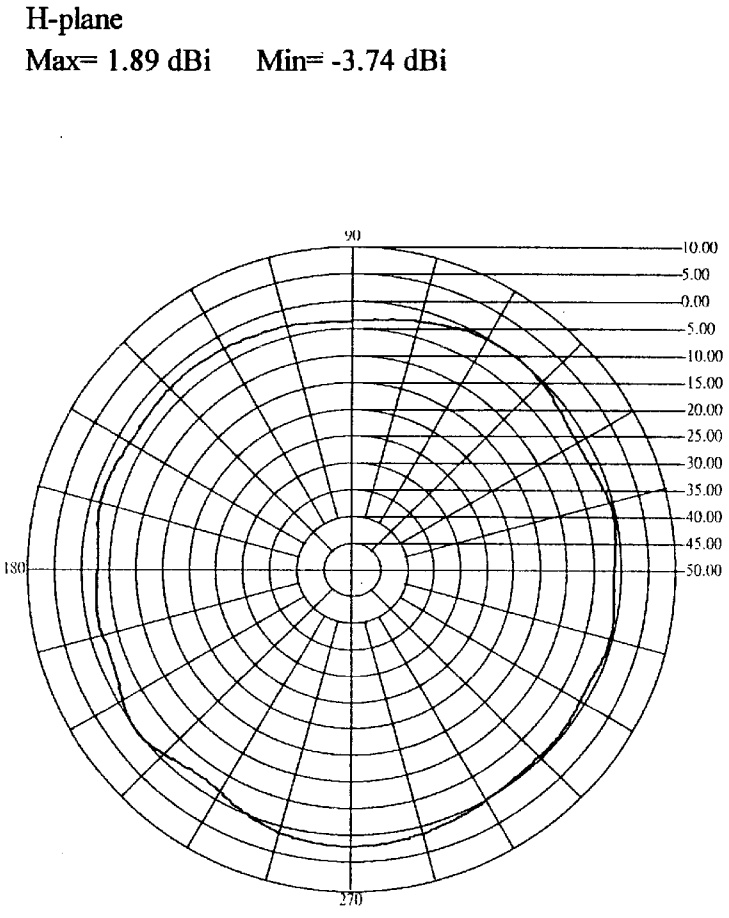
Figure 6:
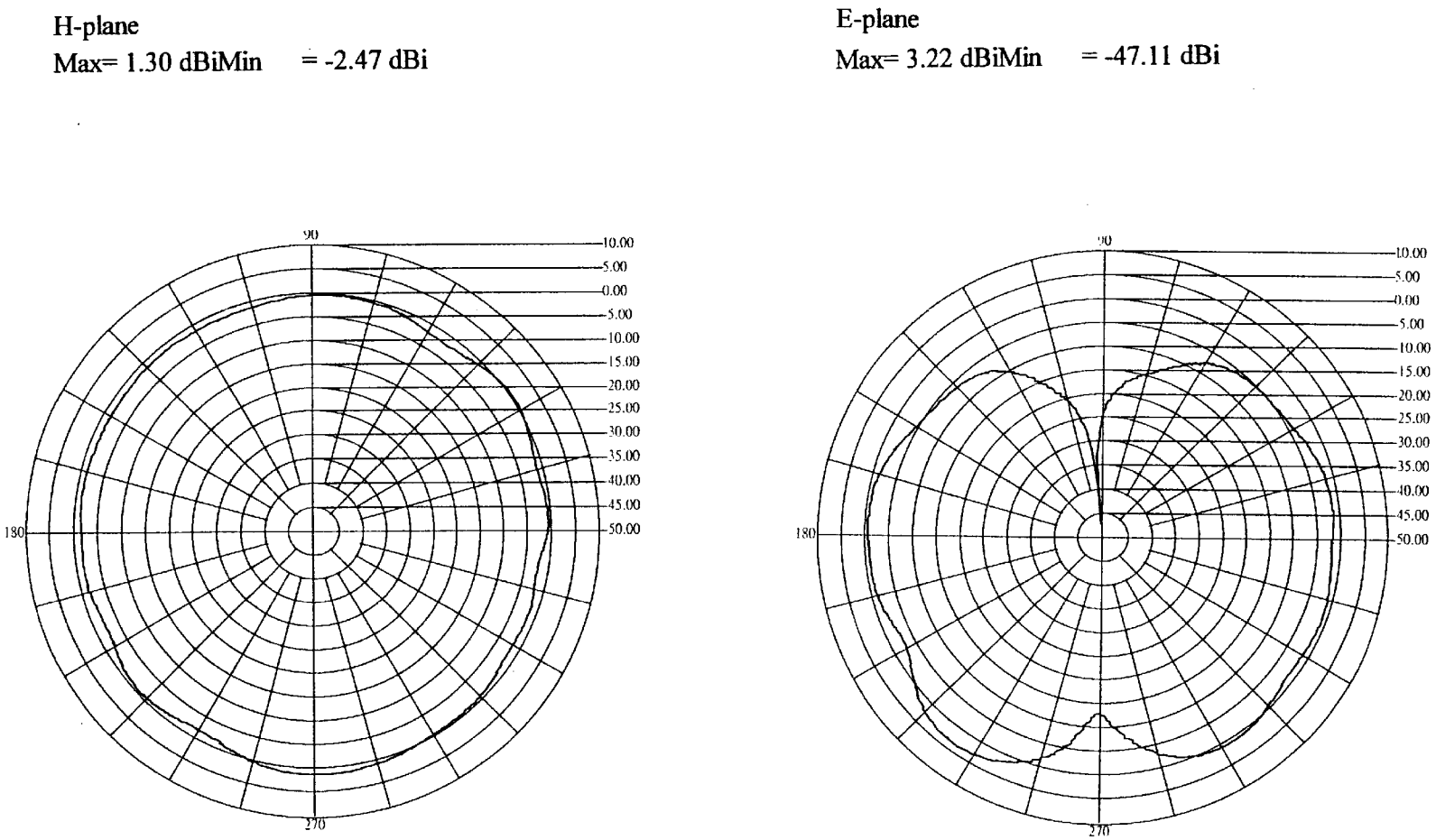
FIG. 6 is a drawing of electromagnetic radiation field used in the present invention for 1900 MHz.

Referring to FIGS. 1 and 2 first of all, taking the practicable electric circuit board 10 shown therein as an example, the length "L" of it is 3.25 cm, the width "W" thereof is 2.0 cm, the thickness "T" (the height) 0.35 cm. There are three axes X, Y and Z shown in the drawings, they represent that the H-planes of the electromagnetic radiation fields shown in FIGS. 4–6 are all the XY-plane, while the E-planes are all the XZ-plane.

In the preferred embodiment shown, the electric circuit board 10 has on the front side thereof two separated grounding areas 11, 12 both with a width of about 1/16λ, an electric supplying line 13 of a single-pole antenna of ¼λ is provided between them, the open circuit end of the electric supplying line 13 is in the shape of an inverted triangle in a way to form a loaded antenna. The electric supplying line 13 thereby forms an electric supplying point 15 on the end thereof. The electric supplying line 13, the open circuit end and the two separated lateral grounding areas 11, 12 together form a coplanar waveguide (CPW) antenna in order to get a gain higher than that of a conventional microstrip antenna. The electric circuit board 10 is further provided on the rear side thereof with a grounding area 16, while the electric supplying line 13 on the front side thereof is provided with a flattened short circuit portion 17 of the single-pole antenna near the electric supplying point 15 to form a planar inverted F-antenna (PIFA). The flattened short circuit portion 17 is like a loaded capacitor; its harmonic oscillation frequency can be adjusted by changing of its position to get different frequencies.

The function of the abovementioned coplanar waveguide and the planar inverted F type altogether can improve bandwidth, radiation efficiency and gain during making coplanar of and miniaturizing the hidden antenna.

Figure 3:
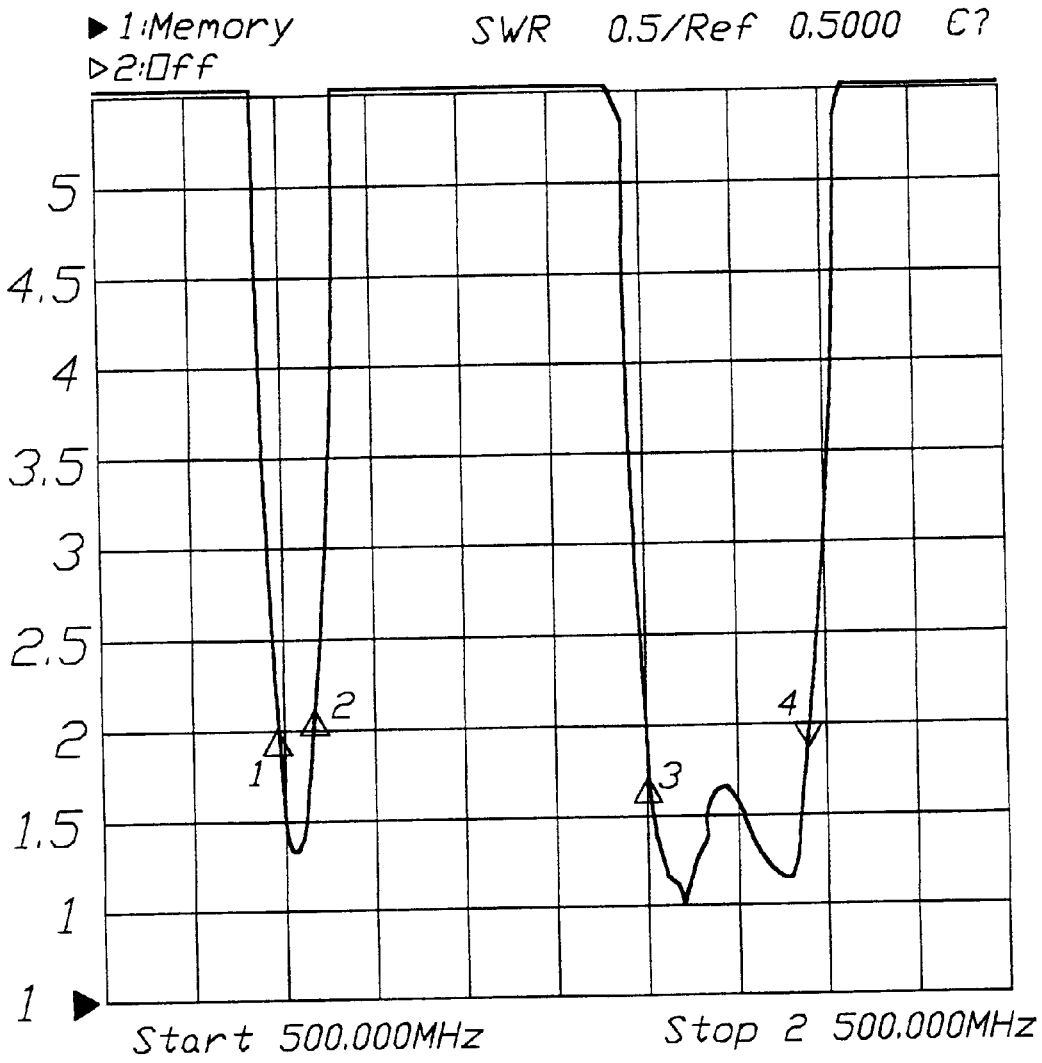
FIG. 3 is a test chart showing the voltage standing wave ratios (V.S.W.R.) in the present invention.

Referring to FIG. 3, the voltage standing wave ratios (V.S.W.R.) of the above stated antenna structure of the present invention are all less than 2 when the structure is verified with an HP8714ET type network analyzer at 890 MHz (the first point), 960 MHz (the second point), 1710 MHz (the third point) and 2055 MHz (the fourth point), the structure is thereby quite ideal.

And as to gain of the antenna, as shown in the drawings of electromagnetic radiation field of FIGS. 4–6: for 900 MHz, it is 0.23 dBi; for 1800 MHz, it is 2.18 dBi; for 1900 MHz, it is 3.22 dBi; the values are all within the specified standard values.

In conclusion, the present invention provides a planar and miniaturized multi-frequency hidden antenna; it is surely inventive and industrial valuable. My invention is to be construed as including all modifications and variations falling within the scope of the appended claims.

What is claimed is:

1. A multi-frequency hidden antenna for mobile phones comprising:

a) an electric circuit board having front and rear sides;

b) an elongated electric supplying line of a single pole $\frac{1}{4}\lambda$ antenna on the front side of the circuit board, an open circuit end of the electric supplying line loaded in the shape of an inverted triangle;

c) first and second spaced apart, elongated grounding areas on the front side of the electric circuit board, one grounding area located adjacent to each opposite side of the elongated electric supplying line, each grounding strip having a width of approximately $\frac{1}{16}\lambda$ and extending in the same direction as the elongated electric supplying line, whereby the electric supplying line, the open circuit end and the first and second grounding areas form a coplanar waveguide antenna;

d) a flattened short circuit portion connected between the elongated electric supplying line and one of the first and second grounding areas to form a planar, inverted F-antenna; and e) a third grounding area on the rear side of the electric circuit board.

* * * * *